United States Patent [19]

Mizuno et al.

[11] 3,967,008

[45] June 29, 1976

[54] TREATMENT OF FABRICS IN MACHINE DRYERS

[75] Inventors: William G. Mizuno; Iris N. Henderson, both of St. Paul, Minn.

[73] Assignee: Economics Laboratory, Inc., St. Paul, Minn.

[22] Filed: May 16, 1974

[21] Appl. No.: 470,565

Related U.S. Application Data

[62] Division of Ser. No. 232,432, March 7, 1973.

[52] U.S. Cl. ..... 427/242; 239/57; 427/394

[51] Int. Cl.[2] ..... B05D 3/12; B05D 3/02

[58] Field of Search ..... 206/0.5, 84, 46 PV; 239/57; 150/1; 252/8.6; 68/17 R; 34/60, 72; 117/139.5 C; 8/115.5; 427/242

[56] References Cited

UNITED STATES PATENTS

| | | | |
|---|---|---|---|
| 3,036,616 | 5/1962 | Allen | 24/DIG. 18 |
| 3,095,722 | 7/1963 | Fox | 68/17 R |
| 3,321,068 | 5/1967 | Beach | 206/16.6 |
| 3,435,537 | 4/1969 | Rumsey | 34/72 |
| 3,442,692 | 5/1969 | Gaiser | 117/120 |
| 3,634,947 | 1/1972 | Furgal | 34/60 |
| 3,686,025 | 8/1972 | Morton | 252/8.6 |
| 3,736,668 | 6/1973 | Dillarstone | 117/139.5 C |

*Primary Examiner*—Harry J. Gwinnell
*Attorney, Agent, or Firm*—Thomas M. Meshbesher

[57] ABSTRACT

Fabrics are treated in machine drying apparatus to reduce static electricity carried by the fabrics, soften the fabrics and improve other fabric properties. A reusable dispenser of solid or semi-solid fabric-conditioning agent is placed within the dryer drum and the fabrics are tumbled in the dryer thereby causing some of the fabric-conditioning agent to be transferred to the fabric. When the dryer is heated, the heat of the dryer helps cause the fabric-conditioning agent to soften and assist in its distribution over the surface of fabric with which it is brought into tumbling contact.

9 Claims, 4 Drawing Figures

TREATMENT OF FABRICS IN MACHINE DRYERS

CROSS-REFERENCE TO RELATED APPLICATION

This is a divisional application of Ser. No. 232,432, filed on Mar. 7, 1973 by William G. Mizuno et al for "Treatment of Fabric in Machine Dryers".

BACKGROUND OF THE INVENTION

In laundering it is common to treat various types of fabrics such as wool, cotton, silk, nylon, polyester, permanentpress, and the like with chemicals which are fabric-conditioning or treating agents to render the fabrics soft to the touch, to reduce tangling, knotting or wrinkling, to render them free of static electricity, to render them bacteria-resistant, to deodorize them, and to otherwise condition them. The use of fabric conditioners permits dried clothes to be sorted and folded more easily and quickly. These results are ordinarily achieved by introducing an aqueous solution or dispersion of the fabric-conditioning agent into the wash water during the washing cycle of the laundry process or by introducing such an aqueous solution or dispersion of fabric-conditioning agent into the rinse water during the rinsing cycle of the laundry process. Experience has shown that addition of the fabric-conditioning agents during the rinse cycle of the laundry process is often significantly more effective than addition of the fabric-conditioning agents during the wash cycle. Since some clothes washing machines do not have automatic fabric softener dispensers, a homemaker must be present during the washing of fabrics to manually add the fabric conditioner during the rinse cycle. This is inconvenient and, consequently, is often forgotten. Even when the washing machine is equipped with an automatic dispenser, the use of a fabric-conditioner is still a messy operation requiring measuring of a liquid suspension, is wasteful and is ecologically undesirable because a significant amount of the fabric conditioner is lost to the drain. Moreover, the fabric softener is usually added to the deep rinse where some soap or detergent and soil may still be present, leading to redeposition problems and interaction between the anionic detergent and cationic softeners (which are mutually incompatible), with subsequent loss of efficiency.

As a result of combinations of the above factors, a survey has shown that may homemakers use fabric softeners irregularly and on the basis of "when I remember" or "when it is needed" with equally irregular performance as regards antistatic and other fabric conditioning properties.

The use of liquid fabric conditioning agents in machine dryers has been suggested in the past, but the idea has not gained widespread commercial acceptance probably as a result of such factors as the need for complex dispensing equipment.

Recently, it was suggested in U.S. Pat. No. 3,442,692 that chemicals which are fabric-conditioning agents might be applied to fabrics by tumbling or co-mingling the fabrics in a laundry dryer in contact with a flexible substrate such as paper or cloth which has been impregnated with a chemical which is a fabric-conditioning agent. The chemical agent is presumably transferred to the fabrics to be conditioned by the tumbling action of the fabric within the dryer. Although this approach has some advantages, it suffers from the disadvantages of cost (e.g. a flexible substrate must be impregnated). Additionally, the substrate must be disposed of after it has been used, thereby presenting ecological problems.

SUMMARY OF THE INVENTION

The present invention is based on the discover that desired fabric properties (e.g. anti-static properties) can be obtained by treating the fabric in a machine dryer with a very small amount of a fabric-conditioning agent such as an anti-static agent, which agent is present in a reusable form. Briefly described, the method of the present invention involves locating within the dryer a consolidated mass (as contrasted to a powder) of heat softenable material comprising, for example, an anti-static agent. Desirably, this mass of solid fabric-conditioner is contained within a dispenser, a portion of which is permeable so that the fabric-conditioner can be released through the dispenser when it is softened by the heat of the dryer. For example, an anti-static agent can be formed into a bar (e.g. like a bar of soap) which is encased within a close fitting cloth envelope. This cloth envelope is preferably mounted on a leading edge of one of the dryer vanes, which vanes form a part of the drum wall. The bar will have a softening or melting point within the range of the dryer temperature. When the fabric to be treated is tumbled within the heated dryer drum, anti-static agent passes through the cloth envelope and is transferred to the fabric.

THE DRAWINGS

DETAILED DESCRIPTION

METHOD OF TREATING FABRICS

The present method of treating fabrics in machine dryers can be understood by referring to the following description when read in conjunction with the drawings.

Figure 1:
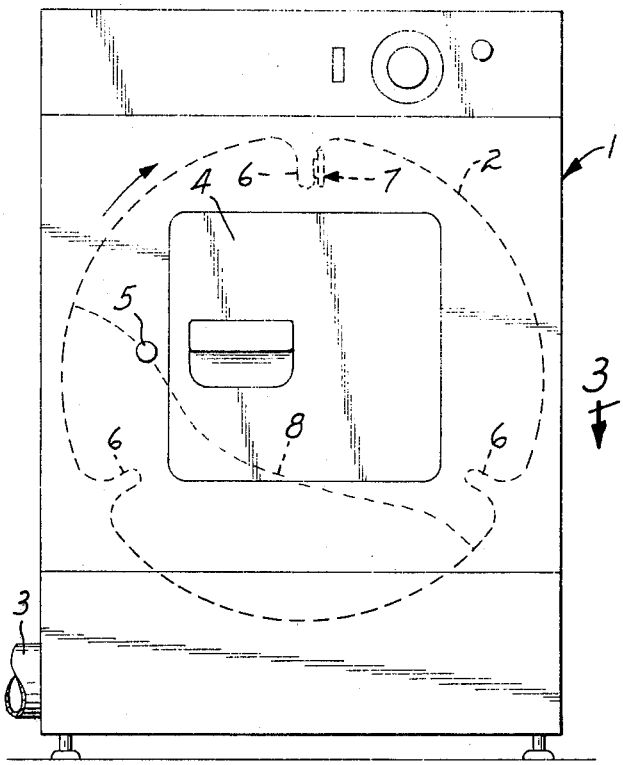
FIG. 1 is a front view of a machine dryer.

In FIG. 1 is shown a machine dryer generally designated by the Numeral 1. The dryer 1 includes a heat source (not shown) which may be electric, gas, or other. The dryer is provided with a rotating drum 2 and an exhaust 3. Dryer 1 is further provided with an access door 4 and a latch 5.

Rotating drum 2 of dryer 1 is typically provided with a plurality of vanes 6 which extend inwardly from the cylindrical wall of drum 2 and which are generally parallel to the axis of rotation of drum 2. Although drum 2 might rotate in either direction, it has arbitrarily been shown in FIG. 1 to rotate in a clockwise direction. A dispenser 7 is carried by one of the vanes 6. The purpose of dispenser 7 is to distribute a fabric-conditioning agent onto fabric 8 being tumbled within drum 2. As shown in FIG. 1, the dispenser 7 is secured to a leading edge of one of the vanes 6. However, if desired, several dispensers 7 can be attached to a single vane 6 or several dispensers 7 can be attached to different vanes 6. Although the dispenser 7 can be loosely tumbled with the clothes or other fabric 8 (i.e. it does not need to be attached to the drum), attaching the dispenser 7 to the drum 2 avoids the disadvantage of having to sort the dispenser out of the clothes 8 after each dryer load. Moreover, various placements of the dispenser 7 on drum 2 can be used to alter dispensing rates or compensate for different dryer types, makes, temperatures, drying cycles, and the like.

In operation, fabric 8 (usually damp and ready to be dried) is placed within drum 2 and the fabric 8 (e.g. clothes) is tumbled within the drum 2 by rotation of the drum 2. In this manner, the fabric 8 is brought into repeated contact with a dispensing surface of dispenser 7. The heat from the dryer causes the fabric-conditioning agent to soften and be transferred to the fabric 8 by contact between the tumbling fabric 8 and the dispensing surface of the dispenser 7.

It has been observed that after a dispenser has been used (e.g. a cloth or bag dispenser), beneficial anti-static properties can be obtained for a cycle or more by merely tumbling dry clothes in an unheated dryer. Presumably, fabric-conditioner which is on the outer surface of the dispenser is transferred to the fabric through abrading contact with the fabric.

THE DISPENSER

Figure 2:
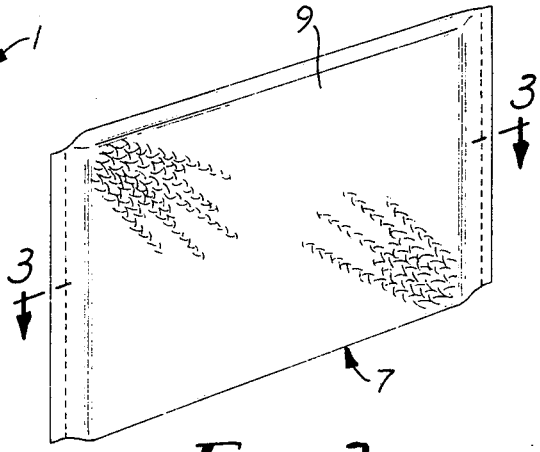
FIG. 2 is a perspective view of a cloth dispenser useful in the practice of the present invention.
Figure 3:
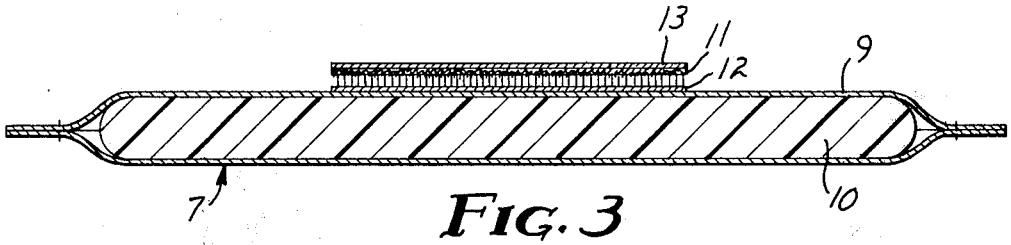
FIG. 3 is a cross-sectional view of the dispenser shown in FIG. 2 as taken along the line 3—3 in the direction of the arrows.

The details of construction of the dispenser 7 of FIG. 1 are shown in more detail in FIGS. 2 and 3. As shown in FIGS. 2 and 3, the dispenser 7 consists of an outer envelope or shell 9, at least a portion of which must either expose or be permeable to the bar or other mass of fabric-conditioning agent being used. It is convenient and economical to construct envelope 9 from cloth or fabric (whether woven or non-woven). Cotton/polyester (e.g. Dacron) twill is a particularly effective material of construction. The envelope or shell 9 contains a bar 10 of solid or semi-solid material comprising a fabric-conditioning agent. This bar 10 is designed to have a melting or softening point within the range of the dryer temperature, all as more fully hereinafter described. Secured to one side of dispenser 7 is means for selectively attaching the dispenser 7 to one of the dryer vanes 6. As shown in FIG. 3, this means of attachment comprises a mateable woven hook 11 and loop 12 fastener. The loop portion 12 of the fastener is desirably attached to a double-faced, pressure sensitive adhesive pad 13. Alternatively, some means for attaching the dispenser 7 could be carried by the drum 2. Any number of snap or other type fasteners which would permit easy and convenient fastening and unfastening of the dispenser 7 can be used.

Figure 4:
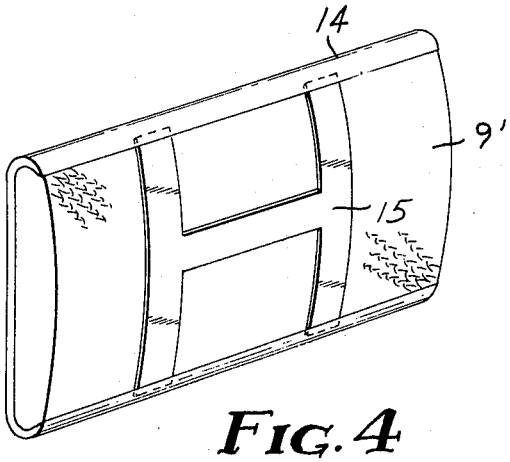
FIG. 4 is a perspective view of an alternative dispenser.

An alternate embodiment of the dispenser 7 is shown in FIG. 4. As shown in this embodiment, the dispenser comprises an envelope of permeable material 9′ which at least partially surrounds a heat softenable bar of fabric-conditioning agent. This bar, contained within envelope 9′, is retained in a plastic bracket 14 by means of a spring clip 15. Means (not shown) are provided for attaching bracket 14 to a surface of dryer drum 2.

FABRIC-CONDITIONING AGENTS

The fabric-conditioning agents useful in the practice of the present invention are those chemicals used for fabric-conditioning, particularly anti-static agents, which can be formed into a bar which will soften when heated in a laundry dryer. Liquid fabric-conditioning agents are not practical for use in the present invention unless they are either used to impregnate or coat a non-interfering carrier which is a heat softenable solid or unless they can be formed into a suitable gel. Thus, the use of solid and semi-solid fabric-conditioning agents (particularly those which impart anti-static properties) is preferred over the use of liquid agents which are formed into a heat softenable mass.

A particularly useful class of fabric-conditioning agents comprises the quaternary ammonium salts. Desirably such quaternary salts will be the chlorides and will contain at least one and usually two $C_{12}$–$C_{24}$ fatty acid radicals (e.g. $C_{18}$ radicals). One preferred product is dimethyl di (hydrogenated tallow) ammonium chloride, whether used alone or in a mixture with other chemicals. If desired, two or more fabric-conditioning agents can be blended together. Additives can be used to improve bar-forming characteristics, modify the softening point of the bar and to control the rate of migration or penetration of the agents through the permeable surface of dispenser 7.

A particular useful mixture of fabric-conditioning agents is a mixture of stearyl dimethyl benzyl ammonium chloride and dimethyl di (hydrogenated tallow) ammonium chloride in a weight ratio of 2–4:1.

In formulating any bar containing a fabric conditioner, the bar should have a melting or softening point within the operating temperature range of the dryer. It is helpful if the bar has a melting point that is broad (i.e., it melts or softens over a wide range of temperatures) as contrasted to a sharply defined or narrow melting point. For many machine dryers, bars having a melting point range of at least 10 Centigrade degrees, and preferably at least 20 Centigrade degrees are preferred. At the present time, the optimum melting point of the bar appears to be within the range of 50°–90° C.

The present invention is further illustrated by the following specific example. Unless otherwise indicated, all parts and percentages are by weight.

EXAMPLE 1

72 parts of stearyl dimethyl benzyl ammonium chloride (melting point of 59°–65°C.), 25 parts of dimethyl di (hydrogenated tallow) ammonium chloride (melting point of 139°–144°C.) and 3 parts of coconut monoethanolamide (melting point of 62°–65°C.) were mixed together as powders to form an intimate mixture having a melting point of 53°–85°C.

Two pieces of white 65% Dacron/35% cotton twill fabric measuring approximately 2-¾ inches by 2-¾ inches were cut. One piece of unifirm woven hooked fastener (Velcro) was sewn to the center of one side of one of the pieces of twill. The underside of the mating piece of a woven loop fastener (Velcro) was covered with a double-faced pressure sensitive adhesive strip. The side of the pressure sensitive tape which was not in contact with the bottom of the loop side of the fastener was permitted to remain covered with release paper to protect the adhesive properties of the strip until such time as it was desired to bond the loop portion of the Velcro pad to a surface of a machine dryer. Next, the two pieces of twill were sewn together in a facing relationship (with Velcro facing inwardly) along three edges to form a small bag which was then turned inside out. 8–10 grams of the mixture of fabric-conditioning agents was then placed in the bag and the bag was sewn shut. The bag and its contents were then heated in a hot air oven (105°–110°C.) to cause the fabric-conditioning agents to soften and fuse together. Upon cooling, the contents of the bag formed a flat hard bar which adhered to the walls of the sealed bag or cloth envelope.

Next, the direction of rotation of the drum of a home machine dryer was determined by closing the dryer door, turning the dryer momentarily on, and then opening the door and observing the direction of rotation. A leading edge of one of the drum vanes was selected for attaching the dispenser just described. The area where the dispenser was to be attached was then cleaned with water and wiped dry. Next, the release paper was removed from the double-faced tape on the back of the dispenser and the dispenser was pressed against the drum vane to firmly attach it to the vane generally in the mid position (from the front to the back of the drum) and so that the edge of the dispenser nearest the axis of drum rotation was near the innermost edge of the drum vane but did not overhang the edge of the drum vane. The hook and loop portions of the fastener attached to the bag were then separated by lifting one end of the dispenser pouch until the pouch became completely detached from the loop portion of the fastener. The remaining half of the fastener (i.e., the loop portion) was then securely attached to the drum vane by firmly pressing with the fingers. The pouch portion of the dispenser was then replaced making certain that the loop and hook portions of the fastener were properly aligned.

A normal load of damp fabric was then placed in the dryer and dried in he usual manner. When removed from the dryer, the fabrics were tested for static electricity and clinging. The results were excellent. No static or clinging were noted.

Repeated tests have been made using, for test purposes, a dryer load including socks, towels and nylon tricot. The dryer cycle used was a heavy setting of 60 minutes duration. Static electricity was checked after each cycle by noting clinging and snapping or cracking electrical discharge. Controlled tests in which the fabric softener and anti-static agent were omitted consistently had static as evidenced by clinging, tangling, and visually observable electrical discharge. By contrast, fabrics dried in a dryer using the dispenser described above showed no static or clinging or tangling tendencies, even after 75 washing and drying cycles. Moreover, use of the present method to impart anti-static and softening properties to the fabric did not materially affect water absorbency as determined according to the procedure described in JAOCS, 42,1084, December, 1965. By contrast, the effect on water absorbency for conventional, proprietary, waterbased, fabric softeners used in the rinse cycle of the laundry process show pronounced adverse effects on water absorbency.

EXAMPLE 2

This example compares the anti-static properties of fabric treated in a machine dryer with the product of Example 1 to the anti-static properties of fabric treated in a washing machine with three proprietary fabric softener/anti-stats.

Conventional fabric softener/anti-stats are used as liquids which are added to clothes during the rinse cycle of the washing process. Such fabric softeners tend to impair the moisture absorbency of fabrics (e.g., towels and diapers) after repeated use and consequently, they are often used only periodically. This causes a see-saw effect on anti-static and other properties.

In this example, the anti-static properties of various softeners were compared using nylon tricot fabric with the results being noted "before and after" rubbing with a nylon tricot block. The test method used was AATCC 115–1965 T (Americal Dyestuff Reporter, May 8, 1967). A fabric softener identical to that of Example 1 was used in every dryer cycle, while the conventional fabric conditioners were used only in cycle 1. The purpose of this test was to simulate the periodic use of the softener/anti-stats and to determine whether or not the effects of the softener/anti-stat would be maintained or would be removed by a single wash. The results which were obtained are shown in Table 1 which follows.

In each instance, the proprietary softeners were added according to their respective manufacturers instructions. Controls 1 and 3 were added during the rinse cycle and Control 2 was added during the wash cycle.

TABLE I

ANTISTATIC PROPERTIES OF NYLON TRICOT

| | | Example 1 | | Control 1[1] | | Control 2[2] | | Control 3[3] | |
|---|---|---|---|---|---|---|---|---|---|
| | | Before | After | Before | After | Before | After | Before | After |
| | Start (No Treatment) | ++ | ++ | ++ | ++ | ++ | ++ | ++ | ++ |
| Wash & Dry | Cycle-1 | − | ± | + | ± | ++ | ++ | − | − |
| Wash & Dry | Cycle-2 | − | + | ++ | ++ | ++ | ++ | − | − |
| Wash & Dry | Cycle-3 | − | − | ++ | ++ | ++ | ++ | ++ | ++ |
| Wash & Dry | Cycle-4 | − | − | ++ | ++ | ++ | ++ | ++ | ++ |
| Wash & Dry | Cycle-5 | − | − | ++ | ++ | ++ | ++ | ++ | ++ |

[1] Nu soft, a product of Best Foods, a division of CPC International
[2] Rain Barrel, a product of S.C. Johnson & Sons, Inc.
[3] Downy, a product of Proctor & Gamble Company
LEGEND
− No static (Cling)
± None in 2 out of 3 Test Pieces
+ Marginal
++ Heavy Static The relative moisture absorbency was also determined with regard to fabrics treated with the fabric softeners of Example 2. The test procedure used was the rewettability or wicking test method reported by Grim et al, JAOCS, 42, 1084, December, 1965. Wick height was measured after ten minutes. Moisture absorbency was poor after the first and second washing and drying cycles for fabrics treated with Controls 1 and 2. The moisture absorbency of fabrics treated with Control 3 was poor after the first washing and drying cycle, but recovered substantially after the second washing and drying cycle. By contrast, the product of this invention (i.e., Example 1) surprisingly gave no measurable impairment in moisture absorbency even after the fifth washing and drying cycle. It is hypothesized that with the product and method of this invention only the surface of the fabric is coated with the fabric-conditioning agent whereas with conventional products (which are used as liquids) the cationic softening agent is absorbed by or on all of the fibers of the fabric.

What is claimed is:

1. The method of conditioning fabrics which comprises the steps of:

a. positioning a fabric-conditioning agent as a bar or consolidated, reuseable form, which form is solid at normal room temperature, within the drum of a machine dryer, said drum including a rotatable cylindrical drum wall, said agent being in a form which is heat softenable at temperatures within the operating temperature range of the dryer; and said agent being enclosed within a dispenser body having a permeable surface through which only a small amount of said enclosed fabric conditioning agent can pass when it is softened by heating of said dispenser body in a dryer, thereby allowing the enclosed fabric-conditioning agent to act as a long lasting reservoir for fabric conditioning agent which, after it passes through the permeable surface, is transferred to the fabric being treated by contact between the fabric and the permeable surface of the dispenser body; said dispenser body being secured to a portion of the dryer drum;

b. drying and conditioning fabric by means of the step of tumbling fabric in said dryer by rotation of said cylindrical drum wall and by heating the dryer during rotation of said drum wall, thereby causing some of the fabric-conditioning agent to be transferred to the fabric by contact between the tumbling fabric and the permeable portion of said dispenser body.

2. The method of claim 1 wherein the fabric-conditioning agent is present as a bar and wherein the permeable portion of the dispenser body is cloth or fabric.

3. The method of claim 2 wherein the dispenser body secured to the leading edge of a vane of said cylinder wall.

4. The method of claim 3 wherein the dispenser is removably attached to said vane.

5. The method of claim 4 wherein the method of attachment includes the use of a woven loop and hook fastener.

6. The method of claim 4 where the bar comprises a quaternary ammonium chloride containing at least one $C_{12}$–$C_{24}$ fatty acid radical.

7. The method of claim 6 wherein the permeable portion of the dispenser body is made of cotton-polyester fabric and wherein the bar comprises dimethyl di (hydrogenated tallow) ammonium chloride and wherein the melting point of said bar is within the range of 50° – 90°C. and extends over at least a 20° Centigrade range.

8. The method of claim 4 wherein the agent is a mixture consisting essentially of stearyl dimethyl benzyl ammonium chloride and dimethyl di (hydrogenated tallow) ammonium chloride in a weight ratio of about 2 – 4:1.

9. The method of claim 1 wherein the dryer cycle of said step (b) is repeated at least five times and the fabric-conditioning agent of step (a) is re-used in each additional cycle.

* * * * *

UNITED STATES PATENT OFFICE
CERTIFICATE OF CORRECTION

PATENT NO. : 3,967,008
DATED : June 29, 1976
INVENTOR(S) : WILLIAM G. MIZUNO and IRIS N. HENDERSON It is certified that error appears in the above-identified patent and that said Letters Patent are hereby corrected as shown below:

Cover sheet, column 1, Item 62, for "1973" read --1972--.
Column 1, line 6, for "1973" read --1972--.
Column 1, line 47, for "may" read --many--.
Column 2, line 5, for "discover" read --discovery--.
Column 4, line 19, for "particular" read --particularly--.
Column 4, line 49, for "unifirm" read --uniform--.
Column 5, line 29, for "he" read --the--.
Column 5, line 55, for "cracking" read --crackling--.
Column 6, lines 18 and 19, for "various softeners" read --various fabric softeners--.
Column 8, lines 6 and 7, for "body secured" read --body is secured--.

Signed and Sealed this

Twenty-third Day of November 1976

[SEAL]

*Attest:*

RUTH C. MASON
*Attesting Officer*

C. MARSHALL DANN
*Commissioner of Patents and Trademarks*